US010352568B2

(12) United States Patent
Eroglu et al.

(10) Patent No.: US 10,352,568 B2
(45) Date of Patent: Jul. 16, 2019

(54) COMBUSTOR ARRANGEMENT FOR A GAS TURBINE

(71) Applicant: Ansaldo Energia Switzerland AG, Baden (CH)

(72) Inventors: Adnan Eroglu, Untersiggenthal (CH); Andrea Ciani, Zurich (CH); Douglas Anthony Pennell, Windisch (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 428 days.

(21) Appl. No.: 14/925,435

(22) Filed: Oct. 28, 2015

(65) Prior Publication Data

US 2016/0123595 A1 May 5, 2016

(30) Foreign Application Priority Data

Oct. 31, 2014 (EP) ..... 14191329

(51) Int. Cl.
*F23R 3/00* (2006.01)
*F23R 3/28* (2006.01)
(Continued)

(52) U.S. Cl.
CPC ..... *F23R 3/286* (2013.01); *F23R 3/06* (2013.01); *F23R 3/346* (2013.01); *F23R 3/36* (2013.01);
(Continued)

(58) Field of Classification Search
CPC .. F23R 3/286; F23R 3/06; F23R 3/346; F23R 3/36; F23R 2900/03341; F23R 3/34; F23C 2900/07021; F23D 2900/14004
See application file for complete search history.

(56) References Cited

U.S. PATENT DOCUMENTS 3,973,395 A * 8/1976 Markowski ..... F23R 3/34 431/352
4,258,544 A * 3/1981 Gebhart ..... F02C 7/222 60/742
(Continued)

FOREIGN PATENT DOCUMENTS

DE 195 47 913 A1 6/1997
EP 0 321 809 A1 6/1989
(Continued)

OTHER PUBLICATIONS

Extended European Search Report dated Mar. 23, 2016, by the European Patent Office in corresponding European Patent Application No. 15188256.0-1605. (9 pages).
(Continued)

*Primary Examiner* — Craig Kim
*Assistant Examiner* — Katheryn A Malatek
(74) *Attorney, Agent, or Firm* — Buchanan Ingersoll & Rooney, PC

(57) ABSTRACT

A combustor arrangement for a gas turbine includes a first burner, a first combustion chamber, a mixer for admixing a dilution gas to the gases leaving the first combustion chamber during operation, a second burner, and a second combustion chamber arranged sequentially in a fluid flow connection. These elements of the combustor arrangement are arranged in a row to form a flow path extending between the first combustion chamber and the second burner. The arrangement includes a central lance body in the flow path, extending from the first burner into the second burner, which lance body includes at least one air duct for providing air for the mixer, wherein the air is injected into the combustor through air supply elements.

20 Claims, 3 Drawing Sheets

(51) Int. Cl.

| | |
|---|---|
| ***F23R 3/06*** | (2006.01) |
| ***F23R 3/34*** | (2006.01) |
| ***F23R 3/36*** | (2006.01) |

(52) U.S. Cl.

CPC ..... *F23C 2900/07021* (2013.01); *F23D 2900/14004* (2013.01); *F23R 3/34* (2013.01); *F23R 2900/03341* (2013.01)

(56) References Cited

U.S. PATENT DOCUMENTS

| | | | | |
|---|---|---|---|---|
| 4,292,801 | A | 10/1981 | Wilkes et al. | |
| 4,389,848 | A | 6/1983 | Markowski et al. | |
| 5,121,597 | A | 6/1992 | Urushidani et al. | |
| 6,427,446 | B1 * | 8/2002 | Kraft ..... | F23R 3/06 60/737 |
| 2009/0277182 | A1 * | 11/2009 | Engelbrecht ..... | F23D 11/36 60/772 |
| 2012/0055162 | A1 | 3/2012 | Eroglu et al. | |
| 2013/0025289 | A1 | 1/2013 | Citeno et al. | |
| 2013/0263571 | A1 | 10/2013 | Stoia et al. | |
| 2014/0123665 | A1 | 5/2014 | Wood et al. | |

FOREIGN PATENT DOCUMENTS

| | | | |
|---|---|---|---|
| EP | 2 116 766 | A1 | 11/2009 |
| EP | 2 397 763 | A1 | 12/2011 |
| EP | 2 400 216 | A1 | 12/2011 |
| EP | 2 551 598 | A2 | 1/2013 |
| EP | 2 647 911 | A2 | 10/2013 |
| EP | 2 725 302 | A1 | 4/2014 |
| EP | 3 015 771 | A1 | 4/2016 |
| JP | 60-17633 | A | 1/1985 |
| WO | WO 03/038253 | A1 | 5/2003 |
| WO | WO 2012/136787 | A1 | 10/2012 |

OTHER PUBLICATIONS

European Search Report dated Apr. 24, 2015, issued in the corresponding Application No. 14191329.3.

European Search Report dated Apr. 24, 2015, issued in the corresponding Application No. 14191332.7.

Brochure, "GT13E2 AEV Burner", An evolutionary gas turine solution, Alstom.

Office Action dated Nov. 6, 2017, by the European Patent Office in corresponding European Patent Application No. 15188256.0.

* cited by examiner

COMBUSTOR ARRANGEMENT FOR A GAS TURBINE

TECHNICAL FIELD

The present invention relates to a combustor arrangement for a gas turbine assembly, comprising a first burner, a first combustion chamber, a mixer for admixing a dilution gas to the hot gases leaving the first combustion chamber during operation, a second burner, and a second combustion chamber arranged sequentially in a fluid flow connection, wherein the first burner, the first combustion chamber, the mixer for admixing the dilution gas before the second burner and the second combustion chamber are arranged in a row to form a flow path extending between the first combustion chamber and the second burner.

PRIOR ART

Gas turbine assemblies are known from a number of prior art documents. WO 03/038253 provides a combustor arrangement for a gas turbine with sequential combustion via a plurality of common uniform annular combustion chambers.

WO 2012/136.787 A1 describes the use of a number of combustion chamber elements which are arranged individually around the rotor of a gas turbine assembly. Each combustion chamber element providing a combustor housing comprising a first and a second burner as well as an intermediate air supply has a tubular or quasi-tubular or shape-changing cross section and each combustion chamber element extends at a radial distance from a central axis of the gas turbine assembly. Fuel supply for the second burner as well as said air supply for the transfer duct are provided with specific ducts being radially oriented to the tubular combustion chamber element.

SUMMARY OF THE INVENTION

Based on this prior art, it is an object of the invention to provide an improved distribution of fuel and air for the two-staged combustor. A further object of the invention is an improved service and replacement approach for the combustor arrangement for a gas turbine assembly.

A combustor arrangement for a gas turbine assembly according to the invention comprises a central lance body arranged inside the flow path and extending from the first burner through the first combustion chamber into the mixer and optionally into the second burner, wherein the central lance body comprises at least one air duct, preferably a plurality of internal air ducts in the lance body, for providing air for at least one mixer between the first burner and the second burner, and optionally beyond, wherein the air is injected into the combustor through air supply elements.

The air ducts in the lance body can be arranged concentrically and they are annular-shaped passages when looked at in a cross section along the longitudinal axis of the combustor arrangement. Optionally they are arranged adjacent one to the other to the outer housing surface of the lance body trunk to provide inter alia thermal isolation to further elements inside the lance body as fuel ducts.

The annular-shaped passages have different lengths to connect with at least two different air supply elements along the lance body trunk. Especially one of the passages leads to the mixer and respective air supple elements and a further passage, usually of an inner annular air duct, leads to a zone beyond the mixer as well as to the free end of the lance body. Optionally further ducts lead to a mixing stage beyond the second burner.

The air supply elements at all stages can comprise annular passages, holes, slits or vents in the housing wall of the lance body or elements extending beyond the housing surface of the trunk of the lance body.

The housing of the combustor arrangement partially encompasses the lance body and is adapted to be connected to a housing of the second burner reaction zone of the turbine, wherein, in the connected position, the free end of the lance body extends into the housing of the second burner reaction zone. Then the central lance body is surrounded by the flow path and is arranged inside a combustor housing. Air supply channels as cavities between the different housing parts or as double walled housings are provided in counter flow direction of the flow path of the hot gases from the burners, i.e. outside of the combustor chamber towards a cavity around the first burner devices of the first burner to be introduced into the burner devices and/or into the air ducts of the lance body as well as optionally into the cavities of the double walled housing wall between the inner flow path of hot gases and the counter-flow air supply.

Within an embodiment of the combustor arrangement the fuel ducts are double line ducts adapted within the lance body to transport a first liquid fuel product and a second gaseous fuel product to the burners.

Each second burner can comprise fuel supply elements extending into the combustion cavity of the associated combustor housing. Such fuel supply elements are then connected with the fuel ducts and they can for example be lobed or micro VG injectors. The fuel supply elements can extend from the trunk of the lance body. They can extend radially from the trunk.

Each first burner can also comprise fuel supply elements extending into the combustion cavity of the associated combustion chamber element. Such fuel supply elements are then connected with the fuel ducts and they can for example be axial swirler injectors, flame sheet injectors, EV or AEV burners, wherein an EV burner is shown in EP 0 321 809 A1 and a so called AEV burner is shown in DE 195 47 913 A1.

The combustor housing can provide a cross-section increasing step of the combustion cavity between the first burner stage towards the first burner reaction zone for flame stabilization and to provide space for the expansion of the combustion gases.

The combustor housing can also provide a cross-section increasing step of the combustion cavity between the second burner stage towards a second burner reaction zone of the combustor arrangement for flame stabilization and to provide space for expansion of the combustion gases.

The combustor arrangement can comprise a plurality of first burners arranged around the central lance, e.g. between two and ten first burners.

The combustor housing partially encompasses the lance body and is adapted to be connected to a housing of the second burner reaction zone of the turbine, wherein, in the connected position, the free end of the lance body extends into the housing of the second burner reaction zone.

The combustor arrangement preferably has a removable central lance body. The central lance body is removably mounted in the combustor arrangement. The combustor arrangement can be designed to allow an axial removal of the central lance body along the longitudinal axis of the combustor arrangement. The cross section of the flow path increases in counter flow direction such that the lance body and fuel injectors extending from the trunk of the lance body can be retracted in axial direction out of the flow path. The first burner typically has a smaller cross section that the first combustion chamber but the lance body shall be retractable together with the first burner, respectively a part of the front plate of the first combustion chamber shall be removable, preferably together with the lance body, to allow an axial retraction of the lance body.

For example the outer diameter of the hot gas flow path inside the sequential combustor arrangement remains constant or increases in counter flow direction from the position of the second burner to the mixer, and further to the first combustion chamber. The first burner is arranged such that it be removed separately before a removal of the central lance body or such that it can be removed together with the central lance body. The central lance body can be removed or withdrawn in counter flow direction of the hot gases in the sequential combustor arrangement.

The central lance provided according to the invention comprises inherently the fuel injection lances mounted within the housing. The central lance can be retrieved from the frame of the gas turbine in one single piece and can be replaced and serviced as such. This is far more effective than the replacement of the single fuel injection lances of WO 2012/136.787.

A further advantage is achieved through the distribution of fuel and air through the central lance body for both stages of the burner. Another advantage of a further embodiment of the invention is the better mixing because air can be injected from the outside housing wall as well as from the lance itself.

The invention provides a combustor arrangement for a gas turbine assembly having a central lance with axial swirlers, thus building a lower-cost and robust so-called constant pressure sequential combustor, which has the main advantage that the central lance is retractable comprising the fuel supply for all stages. The fuel injection for the first burner stage can be additionally staged in the radial, circumferential and axial direction.

It proved to improve the function of the combustor that a sudden expansion, i.e. an sudden increase in cross section, in the form of a backwards facing step or shoulder on both inner and outer side of the annulus follows the annular section of the first stage. Together with the swirl from the first stage, this step stabilizes the flame in the first burner stage in a wide operating range. For low load conditions, fuel can be predominantly supplied to the inner zone with radially staged fuel supply. At higher loads, fuel can be increased to outer stage.

After the first burner reaction zone, a dilution air mixer can be used to reduce the temperature of the hot gases to the level required by the second burner stage. Dilution air mixer can be supplied with air from both outside and inside, forming a double-sided, opposed wall jet mixer. A central-body type reheat burner follows the dilution air mixer. Fuel supply for the second stage burner is provided completely through the central lance body, both for gaseous and liquid fuels.

Burner configuration for the first burner stage can be inter alia axial swirler/injectors or so-called EV or AEV burners as disclosed in EP 0 321 809 A1 for the EV-burner and DE 195 47 913 A1 for the AEV-burner.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
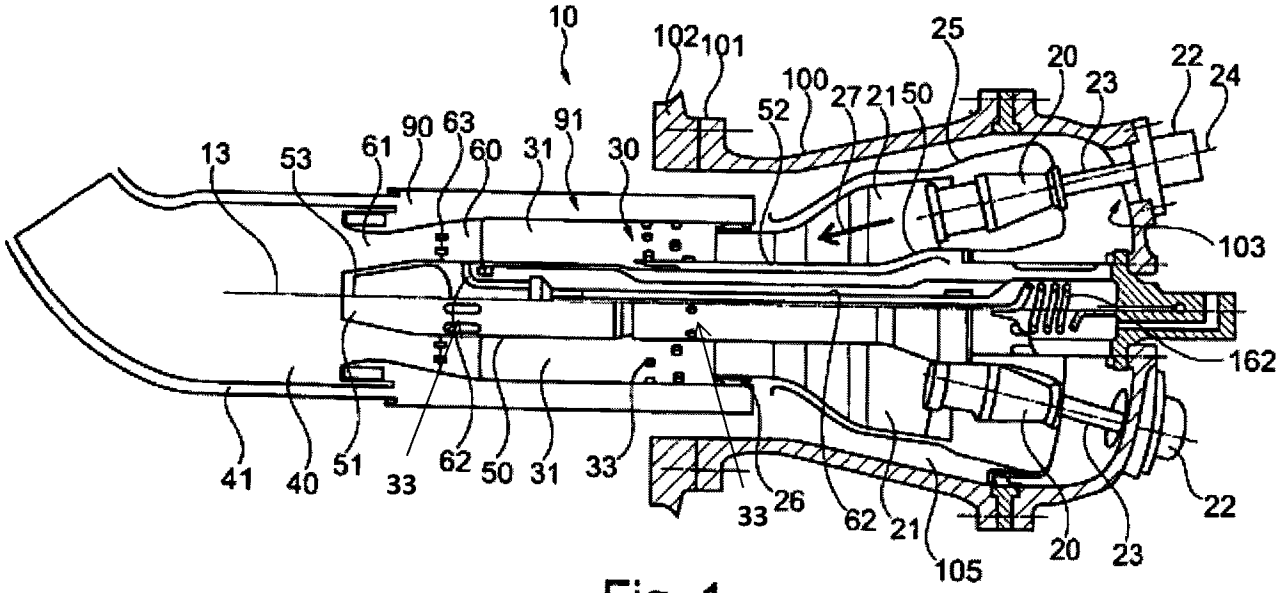
FIG. 1 shows a simplified longitudinal section through a combustor arrangement of a gas turbine assembly according to an embodiment of the invention.

FIG. 1 shows a simplified longitudinal section through a combustor arrangement 10 for a gas turbine assembly according to an embodiment of the invention. The first stage comprises axial swirlers with integrated fuel injection provided in an annulus around a central lance body 50 and covered by an outer cylindrical housing, also called combustor housing 100.

FIG. 1 shows a combustor 10 for a gas turbine assembly 10. Such a gas turbine assembly 10 comprises on the input side a compressor, not shown here, followed by one or more combustor arrangements 10 and finally on the output side a turbine. The combustor arrangement 10 comprises a first burner 20 and a second burner 60 connected downstream of the associated first burner 20. A second burner reaction zone 40 as input stage for the turbine is connected downstream of the second burner 60. The turbine acts downstream of the second reaction zones 40 belonging to the second burner 60.

The combustor 10 of the gas turbine assembly of FIG. 1 has five distinct burner devices such as so-called EV-burner as disclosed in EP 0 321 809 A1 or so-called the AEV-burner as disclosed inter alia in DE 195 47 913 A1. These burner devices form the first burner 20 and are provided around a central longitudinal axis 13 and the longitudinal section shows two of them as they appear in the section view.

Each first burner device of the first burner 20 is arranged downstream of the compressor (not shown) and is acted upon by the air compressed there. The second burner 60 is arranged downstream of the reaction zone 21 belonging to the associated first burner 20 and is provided in an annular region around the lance body 50. The first reaction zone 21 is also called first combustion chamber. Each first burner device of the first burner 20 has a first fuel supply device 22 which supplies a gaseous and/or liquid fuel to said first burner device via a first fuel supply element 23 (here a lance extending into the first burner 20) provided on the longitudinal axis 24 of each first burner device.

The second burner 60 has autonomous second fuel supply elements 63 which likewise ensure the supply of a gaseous and/or a liquid fuel as will be explained later.

Figure 2:
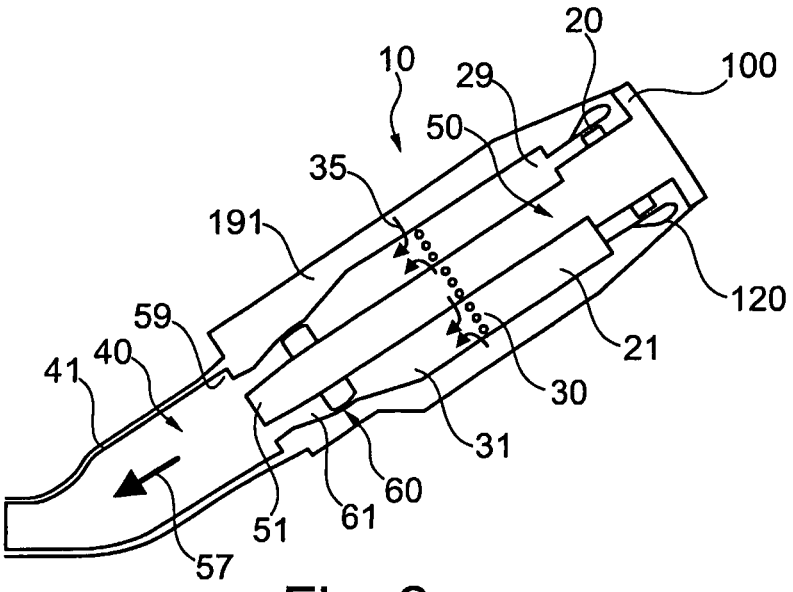
FIG. 2 shows a greatly simplified schematical longitudinal section through a combustor arrangement for a gas turbine assembly according to a further embodiment of the invention.

The first fuel supply device 22 can be connected (not in FIG. 1) with the central lance body 50, preferably integrated as shown within the embodiment of FIG. 2. This enables the complete removal of the lance as a unit with all relating ducts and fuel supply lines as explained below.

The combustor 10 of the gas turbine assembly comprises the combustor housing 100 encompassing the plurality of first burner devices. Housing 100 can be a multi-part housing and being mounted in a flange area 101 to an exterior frame 102. It is also possible that the housing encompasses the exterior frame 102 entirely. Housing part 90 is usually also integrated into the combustor housing 100. FIG. 2 schematically shows such integration.

The different first burner devices are mounted within corresponding openings 103 of the housing 100. Each first burner device comprises a first burner housing 25 extending into the first burner reaction zone 21 and comprising at its free end 26 beyond the first burner reaction zone 21 a blocking and sealing area, especially a hula seal, against the housing part 90 of the combustor arrangement 10.

The number of combustor chambers arranged in this way depends on the size of the gas turbine assembly and on the power output to be achieved. The combustor chamber as accommodated in the housing 100 of a gas turbine assembly 10 is at the same time surrounded by an envelope of air 105, via which the compressed air flows to the first burner 20. The number of first burner devices of the first burner stage 20 can be predetermined to be between e.g. 3 and 10.

The combustion gas path is symbolized here by an arrow 27 and through which the combustion gases of the first burner 20 flow when the combustor of the gas turbine assembly is in operation.

The compressor generates compressed air which is supplied to the first burners 20. A substream of the compressed air may in this case serve as cooling gas or cooling air and be utilized for cooling various components of the combustor 10 of the gas turbine assembly. Here it flows between the housing parts 25 and 100 and provide a thermal isolation between these surfaces. The first fuel supply element 23 injects the fuels directly into the individual first burner device of the first burner 20, said burner device being acted upon by compressed air and being designed as a premix burner. Fuel injection and the respective premix burner are in this case coordinated with one another such as to establish a lean fuel/oxidizer mixture which burns within the first burner reaction zone 21 with favorable values for pollutant emission and efficiency. It is especially noted that the cross-section of the first reaction zone 21 behind the burner device is larger than the cross-section after the first burner 20 and approaching the second burner 60 at the end of zone 21. The combustion gases in this case occurring are supplied to the second burner 60.

The combustion gases from the first reaction zone 21 are cooled to an extent such that fuel injection into the combustion gases, which takes place via the second fuel supply device 63 at the second burner 60, does not lead to undesirable premature auto-ignition outside the second reaction zone 40. For example, the combustion gases are cooled to about 1100° C. or below with the aid of the elongated first reaction zone acting as a heat exchanger.

The fuel for the second stage is supplied from the center of the lance body 50 where on the input side a curled duct 162 provides elasticity when the device changes its dimension due to change of temperature. The spiral duct 162 for an axial compensation of the fuel duct line is then provided as longitudinal duct 62 along the axis 13 inside the lance body 50 of the combustor 10 until the second burner zone. There, an L-shaped outlet provides the liquid into the second burner area 60 through a number of second fuel supply devices 63 to distribute the fuel.

This additional fuel is then supplied in the second burner 60 with the aid of the second fuel supply device 63 comprising injectors. The fuel is added to the combustion gases of the first stage cooled in this way, here, too, the burners and fuel supply being configured so as to form a lean fuel/oxidizer mixture which burns in the second reaction zone 40 with favorable values in terms of pollutant emission and of efficiency.

The combustion gases formed in the second reaction zone 40 are then leaving the combustor arrangement and are led to the turbine. In this context, the central lance body 50 comprises a rounded free end 51, especially an aerodynamically shaped free end. The five first burner devices form a common ring-shaped transfer duct, so that the turbine acting directly downstream can be acted upon uniformly. It is noted that as beyond the first stage 20, the second burner reaction zone 40 is provided with a cross-section enlarging step providing space for the expansion of the fuel-gas mix. The second burner reaction zone 21 is also called second combustion chamber.

As an optional feature the central lance 50 can also provide cooling and process air in an air injection stage, also called mixer 30 between the first burner 20 and the second burner 60. The cooling air is distributed via air supply elements 33. These air supply elements 33 can be provided on both wall parts of the combustor casing, at the inner wall and at the outer wall, i.e. at the cylindrical inner wall of the lance 50 housing and at the cylindrical outer wall of the housing parts 90. To achieve this air ducts are provided within the housing part 90 or the entire housing part 90 comprises an air guiding cavity 91. On the inner side air ducts 52 and 53 are provided within the lance body 50.

It is an advantage of feeding the air from the outer surface housing 90 and from the inner surface housing, especially in air injection stage 30, but also at the end of the lance body 50 with ducts 53 and opposite distribution vents in housing 90 in the lower second burner stage 61, that the air has only to travel half the diameter of the combustor in area 30 (or 61) to thoroughly mix with the combustion gas in the mixing stage 31 (or the mixing stage 61) when travelling to the second burner 60 or to the second burner reaction zone 40. The combustion process can be further enhanced, if short tubes are provided radially or slightly oriented in the direction of the gas flow as air supply elements 33 to inject the air even more evenly distributed within the process cavity between the stages 21 and 31.

It is an advantage of the principle of use of the single central lance body 50, incorporating a plurality of first burner devices, that it is independent from the embodiment chosen for the fuel injection lance with its first and second burners 20 and 60. Although a specific first burner stage 20 from the applicant (GT13E2 AEV Burner by Alstom) is schematically shown in the drawing of FIG. 1, it is clear that the aims of the invention can also be reached, if other first stage burner types as EV burner, axial swirler and flame sheet combustor, to name a few, are used.

On the other side, it is possible that gas turbine assembly 10 is run with only a part of the autonomously operated first burner devices of first burner 20 for part-load operation. Then, there is not necessarily a reduction in operation to the five first burners devices, but the number of first burner devices which are fully in operation can be reduced, here from five to a reduced number. Flexibility, the gain in efficiency and minimization of pollutant emissions in the gas turbine assembly 10 according to the invention can thus be maximized in any operating state.

Figure 3:
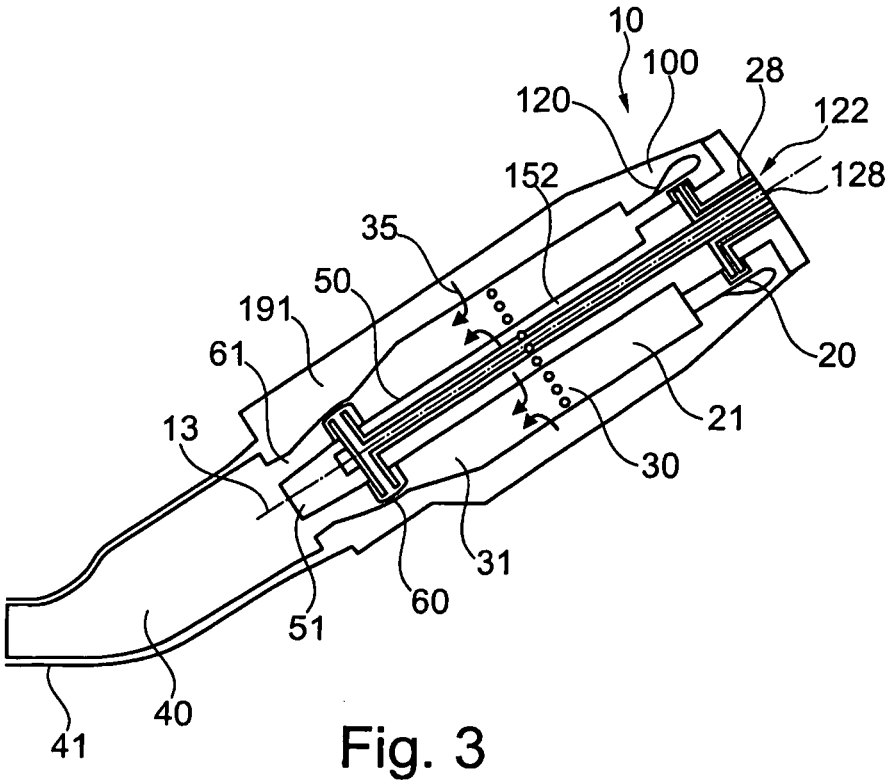
FIG. 3 shows the schematical section from FIG. 2 with dual fuel ducts.

FIG. 2 shows greatly simplified schematical longitudinal section through a combustor 10 for a gas turbine assembly according to a further embodiment of the invention, and FIG. 3 shows the embodiment of FIG. 2 with dual fuel ducts 28 and 128. Same or similar features receive the same or similar reference numerals throughout the drawings.

The combustor arrangement 10 is shown with simplified main parts. The combustor arrangement has an encompassing housing 100 wherein the housing parts 90 of the embodiment of FIG. 1 are here integrated part of the entire housing. The cavity 191 built by the doubled walled housing 100 provides air to all parts of the combustor 10, i.e. to the injector stage 30 as well as to the axial injector/annular swirler 120 building the first burner stage 20. The section increasing step 29 provides the passage to the first burner reaction zone 21. For flame stabilization the cross section of the flow path increases and provides space for an expansion of the combustion gases.

Air from ducts within the central lance 50 and from the encompassing housing cavity 191 are injected at the mixing stage 30 according to the air flow 35 indicating arrows to be mixed within the mixing stage 31. The introduction of this additional air can be provided through simple bores, slits or vents in the housing walls as air supply elements 33.

Then additional fuel is injected at the second burner stage 60 as described in connection with the embodiment of FIG. 1. The combustion gases travel through the lower second burner area 61 over the stump free end 51 of the lance body 50 into the second burner reaction zone 61 where the walls are provided as a double walled sequential liner area 40. Here a second increase in the cross section of the flow path happens to provide space for expansion of the combustion gases when the section increasing step 59 is passed. It is noted that FIG. 2 shows a section with two first burner devices 120. Each of the first burner devices 120 can be separated elements as in FIG. 1 with separate burner housings 25 integrated towards the stump end 51 with still separated cavities or they can be provided together in one cavity encompassing the central lance body 50 in a ring shape (at every cross section view along axis 13). In any case the combustion products are evacuated according to the combustion path arrow 57 towards the turbine (not shown).

It can be seen from FIG. 3 that fuels ducts 28 and 128 are provided within the lance body 50, starting form a common fuel supply line 122 near the axis 13 of the lance body 50. One fuel duct 28 is provided for each of the first burner devices, i.e. for each first burner device or axial swirler/injector 120 of the first stage. A central duct 128 is provided and extends forward until the area of the second burner stage 60, where it branches out into the respective number of second burner devices in area 60 of the second burner 60 to supply the respective fuel supply elements 63. The central duct 128 is surrounded by air duct elements 152 which can be provided as the remaining cavity room or as specific duct lines.

In one embodiment, which can of course be combined with the features of the embodiment of FIG. 1, the fuel ducts are double ducts, comprising one duct for a liquid fuel and one separate duct for a gaseous fuel product. The two ducts can be concentric lines for each fuel duct 28 and 128. The injectors can be inter alia axial swirler injectors in the first stage and lobed or micro VG injectors in the second or reheat stage.

FIG. 1 also shows further optional hula seals between the housing part 90 and the housing of the sequential liner. This enables to separate the housing parts 90 from the main housing of the lance, mounted on the frame 102 so that the inner combustion arrangement 10 with the lance body 50 and all major parts, including the first burner 20 can be retracted from the gas turbine assembly.

Figure 4:
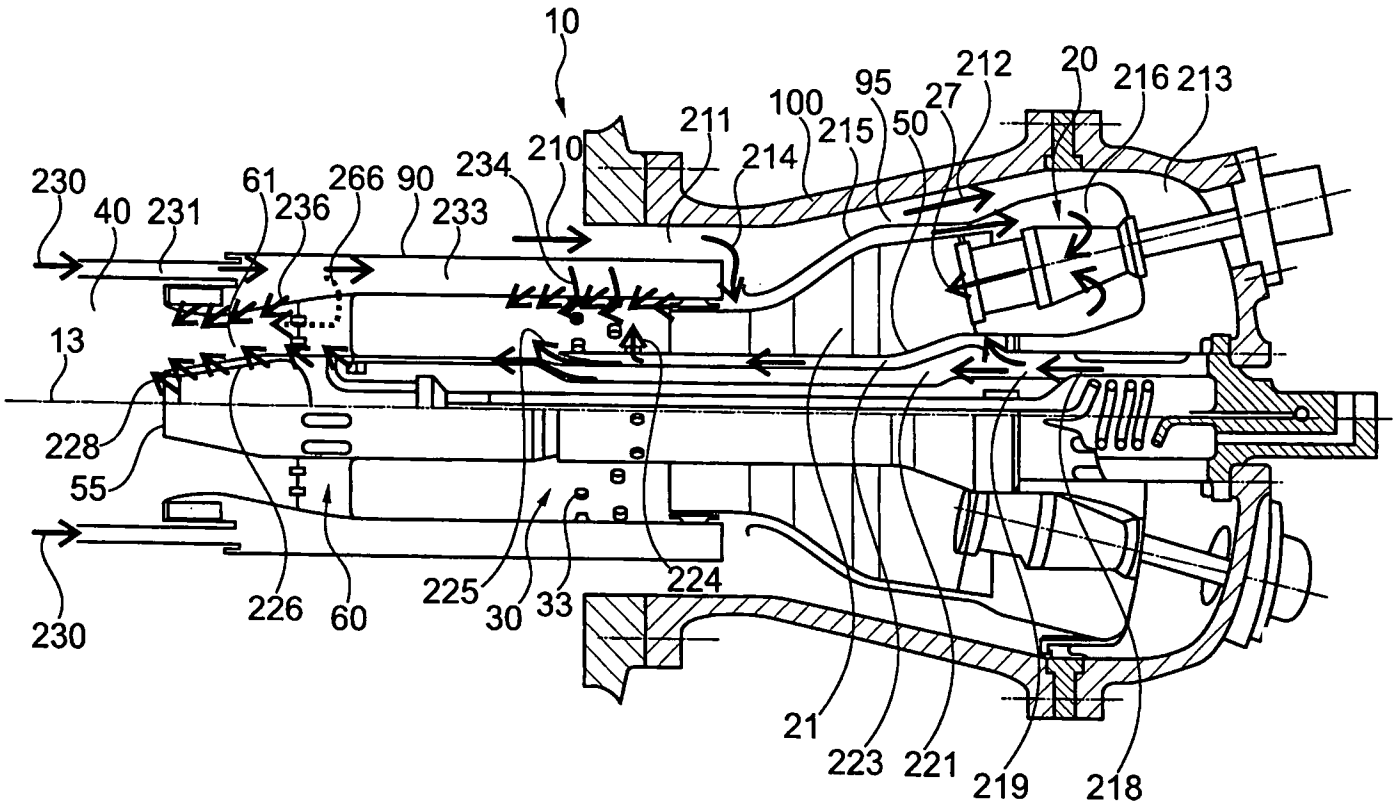
FIG. 4 shows FIG. 1 with specific references to gas flow and gas flow passages.

FIG. 4 shows FIG. 1 with specific references to gas flow and gas flow passages within the lance body 50, the combustor housing 100 and the part housing 90. An annular passage 211 is provided around the housing part 90 and radially delimited by the housing 100. Gas is inflowing according to first inlet arrow 210. It will be explained later that a further annular opening 231 is provided in the sequential liner 41 and shown as second inlet arrow 230 into the cavity 91 in housing part 90.

The annular passage 211 splits off into an burner area 213 around the different first burner devices and around the burner device housings 95 as well as into an device housing passage 215. The respective arrows are gas flow path arrow 212 and 214. The gas in the device housing passage 215 flows in a counter flow compared to main burn flow path 27.

Gas around the burner devices enters the burner devices at arrow 216 and are guided into the combustor reaction zone 21. A further gas flow 218 enters the lance body 50 and divides up in cavity space 219 inside the trunk of lance body 50 into an outer annular space 221 and an inner annular space 223. Both cavities guide gas inside the trunk to the respective outlets in the mixing stage 30 and the second burner stage 60.

Reference numeral 224 at the mixer 30 shows an injection arrow 224 directed radially to inject the gas as dilution gas into the mixer chamber. A further gas portion is guided along the lance body trunk 50 in an annular passage 225 towards the end of the mixing stage.

On the opposite housing 90 side, gas entering through the liner 41 in space 233 is guided through similar holes, vents or annular passages according to the referenced arrow 234 into the mixing stage. Further gas from the space 233 is guided according to arrow 266 as second burner gas into the second burner zone opposite to the fuel injection as explained in connection with FIG. 1. Further second burner stage gas is injected into the lower zone 61 of the second burner through slits, holes or annular passages in the part housing 90 according to the arrow with the reference numeral 236.

Inside the trunk of the lance body 50 at the rounded free end 51 similar gas from the annular passage 221 is injected into the lower zone 61 of the second burner through slits, holes or annular passages in the rounded free end 51 of the lance body 50 according to the arrow with the reference numeral 226.

Furthermore, it is possible that additional gas it injected into the second combustor area or zone 40 at the end surface 55 of the lance body 50 facing this second combustor area 40. The respective arrow has the reference numeral 228. The final gas passages 228 are oriented to inject the gas in an angle of 30 to 60 degrees from the longitudinal axis 13 of the combustor arrangement 10.

LIST OF REFERENCE SIGNS

| | |
|---|---|
| 10 | combustor arrangement for gas turbine assembly |
| 13 | central longitudinal axis |
| 20 | first burner |
| 21 | first burner reaction zone |
| 22 | first fuel supply device |
| 23 | first fuel supply element |
| 24 | longitudinal axis of chamber element |
| 25 | first burner housing |
| 26 | free end |
| 27 | combustion path arrow |
| 28 | first burner dual fuel ducts |
| 29 | section increasing step |
| 30 | mixer/air injection stage |
| 31 | mixing stage |

-continued

| LIST OF REFERENCE SIGNS | |
|---|---|
| 33 | air supply elements |
| 35 | air flow |
| 40 | second burner reaction zone |
| 41 | sequential liner area |
| 50 | central lance body |
| 51 | rounded free end |
| 52 | air duct |
| 53 | air duct |
| 55 | end surface |
| 57 | combustion path arrow |
| 59 | section increasing step |
| 60 | second burner |
| 61 | second burner, lower zone |
| 62 | fuel duct |
| 63 | second fuel supply elements |
| 90 | housing part |
| 91 | cavity |
| 95 | burner device housing |
| 100 | combustor housing |
| 101 | flange area |
| 102 | exterior frame |
| 103 | opening |
| 105 | air envelope/cavity |
| 120 | swirler injector of first stage |
| 122 | common fuel supply line |
| 128 | second burner dual fuel ducts |
| 152 | air duct in the lance body |
| 162 | helix duct |
| 191 | cavity |
| 210 | first inlet arrow/path |
| 211 | annular passage |
| 212 | gas flow path arrow |
| 213 | burner area |
| 214 | gas flow path arrow |
| 215 | device housing passage |
| 216 | arrow at burner devices |
| 218 | further gas flow into lance |
| 219 | cavity space |
| 221 | outer annular space |
| 223 | inner annular space |
| 224 | injection arrow |
| 225 | injection arrow |
| 226 | further second burner stage gas, lance body portion |
| 228 | final gas passage |
| 230 | second inlet arrow/path |
| 231 | further annular opening |
| 233 | space in part housing |
| 234 | inlet arrow (part housing) |
| 236 | further second burner stage gas, part housing portion |
| 266 | second burner gas |

The invention claimed is:

1. A combustor arrangement for a gas turbine assembly, comprising:

a first burner;

a first combustion chamber;

a mixer for admixing a dilution gas to hot gases leaving the first combustion chamber during operation;

a second burner;

a second combustion chamber arranged sequentially in a fluid flow connection, wherein the first burner, the first combustion chamber, the mixer, the second burner and the second combustion chamber are arranged in a row to form a flow path extending between the first combustion chamber and the second burner;

a central lance body arranged inside the flow path and extending from the first burner through the first combustion chamber into the mixer;

wherein the central lance body includes at least one air duct for providing air for the mixer between the first burner and the second burner, wherein the air is to be injected during operation into the combustor arrangement through air supply elements; and wherein the central lance body comprises at least one fuel duct arranged within the central lance body and configured to provide fuel for the second burner, the at least one fuel duct having a curled duct on an input side, a longitudinal duct extending from the curled duct along a longitudinal axis of the central lance body to an L-shaped outlet, and wherein the L-shaped outlet is configured to provide the fuel to the second burner.

2. The combustor arrangement according to claim 1, wherein the at least one air duct in the central lance body comprises a plurality of air ducts in the central lance body, and wherein the plurality of air ducts are concentrically arranged annular-shaped passages along a longitudinal axis of the combustor arrangement and arranged adjacent to an outer housing surface of the central lance body.

3. The combustor arrangement according to claim 2, wherein the annular-shaped passages have lengths to connect with at least two different air supply elements of the air supply elements along the central lance body.

4. The combustor arrangement according to claim 1, wherein the air supply elements comprise:

annular passages, holes, slits or vents in a housing wall of the central lance body.

5. The combustor arrangement according to claim 1, wherein a housing of the combustor arrangement partially encompasses the central lance body and is configured to be connected to a housing of a second burner reaction zone of the gas turbine, wherein, in a connected position, a free end of the central lance body extends into the housing of the second burner reaction zone, wherein the central lance body is surrounded by the flow path and is arranged inside a combustor housing, wherein an air supply is provided in counter flow direction of the flow path outside of the second combustion chamber towards a cavity around first burner devices of the first burner to be introduced into the first burner devices or into the at least one air duct of the central lance body as well as into cavities of a double walled housing wall between the flow path and the air supply.

6. The combustor arrangement according to claim 1, wherein the at least one fuel duct is two fuel ducts arranged within the central lance body, one of the two fuel ducts is configured to transport a first liquid fuel product and the other of the two fuel ducts is configured to transport a second gaseous fuel product to the burners.

7. The combustor arrangement according to claim 1, wherein a housing of the combustor arrangement increases in a cross-section of a combustion cavity between a first burner stage towards a first burner reaction zone.

8. The combustor arrangement according to claim 1, wherein a housing of the combustor arrangement increases in a cross-section of a combustion cavity between a second burner stage towards a second burner reaction zone of the combustor arrangement.

9. The combustor arrangement according to claim 1, wherein the first burner comprises a plurality of first burners, each of the plurality of first burners comprises:

first fuel supply elements extending into a combustion cavity of the associated first burner, wherein the first fuel supply elements are connected with the at least one fuel duct.

10. The combustor arrangement according to claim 1, wherein the first burner comprises between two and ten first burner devices in a first burner stage.

11. The combustor arrangement according to claim 1, wherein the central lance body is removably mounted in the combustor arrangement.

12. The combustor arrangement according to claim 1, wherein a cross section of the flow path increases in a counter flow direction such that the central lance body and fuel injectors extending from the central lance body are retractable in an axial direction out of the flow path.

13. The combustor arrangement according to claim 3, wherein the air supply elements comprise:

annular passages, holes, slits or vents in a housing wall of the central lance body.

14. The combustor arrangement according to claim 13, wherein a housing of the combustor arrangement partially encompasses the central lance body and is configured to be connected to a housing of a second burner reaction zone of the gas turbine, wherein, in a connected position, a free end of the central lance body extends into the housing of the second burner reaction zone, wherein the central lance body is surrounded by the flow path and is arranged inside a combustor housing, wherein an air supply is provided in a counter flow direction of the flow path outside of a combustor chamber towards a cavity around the first burner devices of the first burner to be introduced into the first burner devices or into the air ducts of the central lance body as well as into cavities of a double walled housing wall between the flow path and the air supply.

15. The combustor arrangement according to claim 13, wherein the central lance body further comprises:

a first burner fuel duct for providing the fuel for the first burner.

16. The combustor arrangement according to claim 13, wherein a housing of the combustor arrangement increases in a cross-section of a combustion cavity between a first burner stage towards a first burner reaction zone.

17. The combustor arrangement according to claim 13, wherein a housing of the combustor arrangement increases in a cross-section of the combustion cavity between a second burner stage towards a second burner reaction zone of the combustor arrangement.

18. The combustor arrangement according to claim 13, wherein the second burner comprises a plurality of second burners, each of the plurality of second burners comprises:

second fuel supply elements extending into a combustor cavity outside the central lance body, wherein the second fuel supply elements are connected with the at least one fuel duct, wherein the second fuel supply elements are lobed injectors.

19. The combustor arrangement according to claim 1, wherein the second burner comprises a plurality of second burners, each of the plurality of second burners comprises:

second fuel supply elements extending into a combustor cavity outside the central lance body, wherein the second fuel supply elements are connected with the at least one fuel duct.

20. A combustor arrangement for a gas turbine assembly, comprising:

a first burner;

a first combustion chamber;

a mixer for admixing a dilution gas to hot gases leaving the first combustion chamber during operation;

a second burner;

a second combustion chamber arranged sequentially in a fluid flow connection, wherein the first burner, the first combustion chamber, the mixer, the second burner and the second combustion chamber are arranged in a row to form a flow path extending between the first combustion chamber and the second burner;

a central lance body arranged inside the flow path and extending from the first burner through the first combustion chamber into the mixer;

wherein the central lance body includes at least one air duct for providing air for the mixer between the first burner and the second burner, wherein the air is to be injected during operation into the combustor arrangement through air supply elements;

wherein the central lance body comprises at least one fuel duct arranged within the central lance body and configured to provide fuel for the second burner, the at least one fuel duct having a curled duct on an input side, a longitudinal duct extending from the curled duct along a longitudinal axis of the central lance body to an outlet, and wherein the outlet is configured to provide the fuel to the second burner; and wherein the central lance body is removably mounted in the combustor arrangement, and wherein a cross section of the flow path increases in a counter flow direction such that the central lance body and fuel injectors extending from the central lance body are retractable in an axial direction out of the flow path.

* * * * *